US010535455B2

(12) United States Patent
Harada et al.

(10) Patent No.: US 10,535,455 B2
(45) Date of Patent: Jan. 14, 2020

(54) SOFT MAGNETIC ALLOY AND MAGNETIC DEVICE

(71) Applicant: TDK CORPORATION, Tokyo (JP)

(72) Inventors: Akihiro Harada, Tokyo (JP); Hiroyuki Matsumoto, Tokyo (JP); Kenji Horino, Tokyo (JP); Kazuhiro Yoshidome, Tokyo (JP); Akito Hasegawa, Tokyo (JP); Hajime Amano, Tokyo (JP); Kensuke Ara, Tokyo (JP); Seigo Tokoro, Tokyo (JP); Shota Otsuka, Tokyo (JP)

(73) Assignee: TDK CORPORATION, Tokyo (JP)

( * ) Notice: Subject to any disclaimer, the term of this patent is extended or adjusted under 35 U.S.C. 154(b) by 164 days.

(21) Appl. No.: 15/880,920

(22) Filed: Jan. 26, 2018

(65) Prior Publication Data

US 2018/0218810 A1 Aug. 2, 2018

(30) Foreign Application Priority Data

Jan. 30, 2017 (JP) ..... 2017-014777

(51) Int. Cl.

| | |
|---|---|
| ***H01F 27/255*** | (2006.01) |
| ***H01F 1/153*** | (2006.01) |
| ***H01F 27/28*** | (2006.01) |
| ***H01F 41/02*** | (2006.01) |
| ***H01F 41/06*** | (2016.01) |

(52) U.S. Cl.

CPC ..... *H01F 1/15308* (2013.01); *H01F 27/255* (2013.01); *H01F 27/2823* (2013.01); *H01F 41/0226* (2013.01); *H01F 41/0246* (2013.01); *H01F 41/06* (2013.01)

(58) Field of Classification Search

CPC ..... H01F 5/00; H01F 27/00–36; C21D 5/00; C21D 6/00

USPC .... 336/65, 83, 212, 233–234; 148/304, 307, 148/321, 403, 579, 612

See application file for complete search history.

(56) References Cited

U.S. PATENT DOCUMENTS

| | | | | |
|---|---|---|---|---|
| 2006/0000524 | A1* | 1/2006 | Ogawa | H01F 1/15308 148/304 |
| 2006/0170524 | A1* | 8/2006 | Fujiwara | H01F 1/15366 336/83 |
| 2007/0251821 | A1* | 11/2007 | Yanagitani | C23C 14/3414 204/298.13 |
| 2007/0295429 | A1* | 12/2007 | Yi | C22C 45/02 148/403 |
| 2010/0043927 | A1* | 2/2010 | Makino | C21D 5/00 148/612 |
| 2010/0300876 | A1* | 12/2010 | Hou | C22F 1/10 204/298.13 |
| 2012/0199254 | A1 | 8/2012 | Urata et al. | |
| 2016/0177429 | A1 | 6/2016 | Urata et al. | |
| 2018/0073117 | A1 | 3/2018 | Urata et al. | |
| 2018/0233258 | A1* | 8/2018 | Chinnasamy | H01F 1/15333 |
| 2018/0322991 | A1* | 11/2018 | Koshiba | H01F 1/15308 |

FOREIGN PATENT DOCUMENTS

| | | | |
|---|---|---|---|
| CN | 102471856 | A | 5/2012 |
| EP | 0455113 | A2 | 11/1991 |
| EP | 3093364 | A1 | 11/2016 |
| JP | H07-268566 | A | 10/1995 |
| JP | H09-213514 | A | 8/1997 |
| JP | 2000-144349 | A | 5/2000 |
| JP | 3342767 | B2 | 11/2002 |
| JP | 2011-195936 | A | 10/2011 |

* cited by examiner

*Primary Examiner* — Tuyen T Nguyen
(74) *Attorney, Agent, or Firm* — Oliff PLC

(57) ABSTRACT

A soft magnetic alloy including a main component having a compositional formula of $(Fe_{(1-(\alpha+\beta))}X1_{\alpha}X2_{\beta})_{(1-(a+b+c))}M_aB_bP_c$, and a sub component including at least C, S and Ti, wherein X1 is one or more selected from the group including Co and Ni, X2 is one or more selected from the group including Al, Mn, Ag, Zn, Sn, As, Sb, Bi, and rare earth elements, "M" is one or more selected from the group including Nb, Hf, Zr, Ta, Mo, W, and V, $0.020 \leq a \leq 0.14$, $0.020 \leq b \leq 0.20$, $0 \leq c \leq 0.040$, $\alpha \geq 0$, $\beta \geq 0$, and $0 \leq \alpha+\beta \leq 0.50$ are satisfied, when entire said soft magnetic alloy is 100 wt %, a content of said C is 0.001 to 0.050 wt %, a content of said S is 0.001 to 0.050 wt %, and a content of said Ti is 0.001 to 0.080 wt %, and when a value obtained by dividing the content of said C by the content of said S is C/S, then C/S satisfies $0.10 \leq C/S \leq 10$.

14 Claims, No Drawings

SOFT MAGNETIC ALLOY AND MAGNETIC DEVICE

BACKGROUND OF THE INVENTION

1. Field of the Invention

The present invention relates to a soft magnetic alloy and a magnetic device.

2. Description of the Related Art

Recently, for electronic, information, and communication devices, lower power consumption and higher efficiency are demanded. Further, in order to achieve a low-carbon society, such demands are even stronger. Thus, a reduction of an energy loss and an improvement of power supply efficiency are demanded also for a power circuit of electronic, information and communication devices. Further, for a magnetic core of a magnetic element used for the power supply circuit, an improvement of a saturation magnetic flux density, a reduction of a core loss, and an improvement of a magnetic permeability are demanded. When the core loss is reduced, the loss of the electric energy is smaller, and when the magnetic permeability is improved, the magnetic element can be downsized, hence a higher efficiency can be attained and energy can be saved.

Patent document 1 discloses a Fe—B-M (M=Ti, Zr, Hf, V, Nb, Ta, Mo, W) based soft magnetic amorphous alloy. This soft magnetic amorphous alloy exhibits good soft magnetic properties such as a high saturation magnetic flux density or so compared to the commercially available Fe-amorphous material.

[Patent document 1] JP Patent No. 3342767

SUMMARY OF THE INVENTION

Note that, as a method for reducing the core loss of the above mentioned magnetic core, a reduction of a coercivity of the magnetic material constituting the magnetic core is considered.

The patent document 1 discloses that Fe-based soft magnetic alloy can improve the soft magnetic property by depositing a fine crystal phase. However, a composition capable of stably depositing the fine crystal phase has not been thoroughly studied.

The present inventors have carried out keen study regarding the composition capable of stably depositing the fine crystal phase. As a result, they have found that the composition different from that disclosed in the patent document 1 can stably deposit the fine crystal phase.

The object of the present invention is to provide the soft magnetic alloy or so which simultaneously satisfies a high saturation magnetic flux density, a low coercivity, and a high magnetic permeability μ'.

In order to attain the above mentioned object, the soft magnetic alloy according to the present invention comprises a main component composed of a compositional formula of $(Fe_{(1-(\alpha+\beta))}X1_{\alpha}X2_{\beta})_{(1-(a+b+c))}M_aB_bP_c$, and a sub component including at least C, S and Ti, wherein X1 is one or more selected from the group consisting of Co and Ni, X2 is one or more selected from the group consisting of Al, Mn, Ag, Zn, Sn, As, Sb, Bi, and rare earth elements, "M" is one or more selected from the group consisting of Nb, Hf, Zr, Ta, Mo, W, and V, $0.020 \le a \le 0.14$, $0.020 \le b \le 0.20$, $0 \le c \le 0.040$, $\alpha \ge 0$, $\beta \ge 0$, and $0 \le \alpha+\beta \le 0.50$ are satisfied, when entire said soft magnetic alloy is 100 wt %, a content of said C is 0.001 to 0.050 wt %, a content of said S is 0.001 to 0.050 wt %, and a content of said Ti is 0.001 to 0.080 wt %, and when a value obtained by dividing the content of said C by the content of said S is C/S, then C/S satisfies $0.10 \le C/S \le 10$.

The above mentioned soft magnetic alloy according to the present invention tends to easily have the Fe-based nanocrystal alloy by carrying out a heat treatment. Further, the above mentioned Fe-based nanocrystal alloy has a high saturation magnetic flux density, low coercivity, and high magnetic permeability μ', thus a soft magnetic alloy having preferable soft magnetic properties is obtained.

The soft magnetic alloy according to the present invention may satisfy $0.73 \le 1-(a+b+c) \le 0.93$.

The soft magnetic alloy according to the present invention may satisfy $0 \le \alpha\{1-(a+b+c)\} \le 0.40$.

The soft magnetic alloy according to the present invention may satisfy $\alpha=0$.

The soft magnetic alloy according to the present invention may satisfy $0 \le \beta\{1-(a+b+c)\} \le 0.030$.

The soft magnetic alloy according to the present invention may satisfy $\beta=0$.

The soft magnetic alloy according to the present invention may satisfy $\alpha=\beta=0$.

The soft magnetic alloy according to the present invention may comprise a nanohetero structure composed of an amorphous phase and initial fine crystals, and said initial fine crystals exist in said amorphous phase.

The soft magnetic alloy according to the present invention may have the initial fine crystals having an average grain size of 0.3 to 10 nm.

The soft magnetic alloy according to the present invention may have a structure composed of Fe-based nanocrystals.

The soft magnetic alloy according to the present invention may have the Fe-based nanocrystals having an average grain size of 5 to 30 nm.

The soft magnetic alloy according to the present invention may be formed in a ribbon form.

The soft magnetic alloy according to the present invention may be formed in a powder form.

Also, the magnetic device according to the present invention is made of the above mentioned soft magnetic alloy.

DESCRIPTION OF THE PREFERRED EMBODIMENTS

Hereinafter, an embodiment of the present invention will be described.

The soft magnetic alloy according to the present embodiment has a main component having a compositional formula of $(Fe_{(1-(\alpha+\beta))}X1_{\alpha}X2_{\beta})_{(1-(a+b+c))}M_aB_bP_c$, and a sub component including at least C, S and Ti, wherein X1 is one or more selected from the group consisting of Co and Ni, X2 is one or more selected from the group consisting of Al, Mn, Ag, Zn, Sn, As, Sb, Bi, and rare earth elements, "M" is one or more selected from the group consisting of Nb, Hf, Zr, Ta, Mo, W, and V, $0.020 \le a \le 0.14$, $0.020 \le b \le 0.20$, $0 \leq c \leq 0.040$, $\alpha \geq 0$, $\beta \geq 0$, and $0 \leq \alpha + \beta \leq 0.50$ are satisfied, when entire said soft magnetic alloy is 100 wt %, a content of said C is 0.001 to 0.050 wt %, a content of said S is 0.001 to 0.050 wt %, and a content of said Ti is 0.001 to 0.080 wt %, and when a value obtained by dividing the content of said C by the content of said S is C/S, then C/S satisfies $0.10 \leq C/S \leq 10$.

The soft magnetic alloy having the above mentioned composition tends to easily be the soft magnetic alloy composed of the amorphous phase, and not including the crystal phase having a crystal of grain size larger than 30 nm. Further, when heat treating the soft magnetic alloy, the Fe-based nanocrystals are easily deposited. Further, the soft magnetic alloy including Fe-based nanocrystals tends to have good magnetic properties.

In other words, the soft magnetic alloy having the above mentioned composition tends to be a starting material of the soft magnetic alloy deposited with the Fe-based nanocrystals.

The Fe-based nanocrystals are the crystals having the grain size of nano-order, and the crystal structure of Fe is bcc (body-centered cubic structure). In the present embodiment, the Fe-based nanocrystals having the average grain size of 5 to 30 nm are preferably deposited. The soft magnetic alloy deposited with such Fe-based nanocrystals tends to have increased saturation magnetic flux density, and decreased coercivity. Further, the magnetic permeability μ' tends to easily increase. Note that, the magnetic permeability μ' refers to the real part of the complex magnetic permeability.

Note that, the soft magnetic alloy prior to the heat treatment may be completely formed only by the amorphous phase, but preferably comprises the nanohetero structure which is formed of the amorphous phase and the initial fine crystals having the grain size of 15 nm or less, and the initial fine crystals exist in the amorphous phase. By having the nanohetero structure of which the initial fine crystals exist in the amorphous phase, the Fe-based nanocrystals can be easily deposited during the heat treatment. Note that, in the present embodiment, the initial fine crystals preferably have the average grain size of 0.3 to 10 nm.

Hereinafter, each components of the soft magnetic alloy according to the present embodiment will be described in detail.

"M" is one or more elements selected from the group consisting of Nb, Hf, Zr, Ta, Mo, W, and V. "M" is preferably one or more elements selected from a group consisting of Nb, Hf, and Zr. When "M" is one or more elements selected from the group consisting of Nb, Hf, and Zr, the crystal phase having a crystal larger than the grain size of 30 nm will be formed even less in the soft magnetic alloy before the heat treatment.

The content (a) of "M" satisfies $0.020 \leq a \leq 0.14$. The content of "M" is preferably $0.020 \leq a \leq 0.10$. If (a) is small, the crystal phase having a crystal larger than the grain size of 30 nm is easily formed in the soft magnetic alloy before the heat treatment, and if the crystal phase is formed, the Fe-based nanocrystals cannot be deposited by the heat treatment, thus the coercivity tends to easily increase and the magnetic permeability μ' tends to easily decrease. If (a) is large, the saturation magnetic flux density tends to easily decrease.

The content (b) of B satisfies $0.020 \leq b \leq 0.20$. Also, preferably it is $0.020 \leq b \leq 0.14$. If (b) is small, the crystal phase having a crystal larger than the grain size of 30 nm is easily formed in the soft magnetic alloy before the heat treatment, and if the crystal phase is formed, Fe-based nanocrystals cannot be deposited by the heat treatment, thus the coercivity tends to easily increase. If (b) is large, the saturation magnetic flux density tends to easily decrease.

The content (c) of P satisfies $0 \leq c \leq 0.040$. It also may be $c=0$. That is, P may not be included. By including P, the magnetic permeability μ' tends to easily improve. Also, from the point of attaining good values for all of the saturation magnetic flux density, the coercivity, and the magnetic permeability μ', the content (c) of P is preferably $0.001 \leq c \leq 0.040$, and more preferably $0.005 \leq c \leq 0.020$. If (c) is large, the crystal phase having a crystal larger than the grain size of 30 nm is easily formed in the soft magnetic alloy before the heat treatment, and if the crystal phase is formed, the Fe-based nanocrystals cannot be deposited by the heat treatment, thus the coercivity tends to easily increase and the magnetic permeability μ' tends to easily decrease.

For the content $(1-(a+b+c))$ of Fe, there is no particular limit, but preferably $0.73 \leq (1-(a+b+c)) \leq 0.93$ is satisfied. By having $(1-(a+b+c))$ within the above mentioned range, the crystal phase having a crystal larger than the grain size of 30 nm will be formed even less in the soft magnetic alloy before the heat treatment.

Further, the soft magnetic alloy according to the present embodiment has C, S, and Ti as the subcomponent besides the above mentioned main component. When the entire soft magnetic alloy is 100 wt %, the content of C is 0.001 to 0.050 wt %, the content of S is 0.001 to 0.050 wt %, the content of Ti is 0.001 to 0.080 wt %. Further, when the value obtained by dividing said content of C with said content of S, then C/S satisfies $0.10 \leq C/S \leq 10$.

By all of C, S, and Ti satisfying the above mentioned content, the soft magnetic alloy simultaneously satisfying a high saturation magnetic flux density, a low coercivity, and a high magnetic permeability μ'. The above mentioned effect is exhibited by having all of C, S, and Ti at the same time. If one or more among C, S, and Ti are not included, then the coercivity increases, and the magnetic permeability μ' decreases.

Also, if C/S is out of the above mentioned range, then the coercivity tends to increase, and the magnetic permeability μ' tends to decrease.

By having all of C, S, and Ti in the above mentioned contents, even if the content (a) of M is small (for example, $0.020 \leq a \leq 0.050$), the initial fine crystals having a grain size of 15 nm or less tends to easily form. As a result, the soft magnetic alloy simultaneously satisfying a high saturation magnetic flux density, a low coercivity, and a high magnetic permeability μ' can be obtained. The above mentioned effect is exhibited by having all of C, S, and Ti at the same time. If one or more among C, S, and Ti are not included, particularly when the content (a) of M is small, the crystal phase having the crystal of the grain size larger than 30 nm tends to easily form in the soft magnetic alloy before the heat treatment, and the Fe-based nanocrystals cannot be deposited by the heat treatment, thus the coercivity tends to easily increase. In other words, in case of having all of C, S, and Ti, even if the content (a) of M is small (for example, $0.020 \leq a \leq 0.050$), the crystal phase having a crystal of grain size larger than 30 nm is scarcely formed. Further, if the content of M is small, the content of Fe can be increased, thus the soft magnetic alloy simultaneously satisfying a high saturation magnetic flux density, a low coercivity, and a high magnetic permeability μ' can be obtained.

The content of C is preferably 0.001 wt % or more and 0.040 wt % or less, and more preferably 0.005 wt % or more and 0.040 wt % or less. The content of S is preferably 0.001 wt % or more and 0.040 wt % or less, and more preferably 0.005 wt % or more and 0.040 wt % or less. The content of Ti is preferably 0.001 wt % or more and 0.040 wt % or less, and more preferably 0.005 wt % or more and 0.040 wt % or less. Further, when the value obtained by dividing said content of C with said content of S, then C/S preferably satisfies $0.25 \leq C/S \leq 4.0$. When the content of C, S, and/or Ti are within the above mentioned range, and C/S satisfies the above mentioned range, then particularly the coercivity tends to easily decrease and the magnetic permeability μ' tends to easily increase.

Also, for the soft magnetic alloy according to the present embodiment, a part of Fe may be substituted with X1 and/or X2.

X1 is one or more elements selected from a group consisting of Co and Ni. The content of X1 may be $\alpha=0$. That is, X1 may not be included. Also, the number of atoms of X1 is preferably 40 at % or less with respect to 100 at % of the number of atoms of the entire composition. That is, $0 \leq \alpha\{1-(a+b+c)\} \leq 0.40$ is preferably satisfied.

X2 is one or more elements selected from a group consisting of Al, Mn, Ag, Zn, Sn, As, Sb, Bi, N, O, and rare earth elements. The content of X2 may be $\beta=0$. That is, X2 may not be included. Also, the number of atoms of X2 is preferably 3.0 at % or less with respect to 100 at % of the number of atoms of the entire composition. That is, $0 \leq \beta\{1-(a+b+c)\} \leq 0.030$ may be satisfied.

The range of the substitution amount of Fe with X1 and/or X2 is half or less of Fe based on the number of atoms. That is, $0 \leq \alpha+\beta \leq 0.50$ is satisfied. In case of $\alpha+\beta>0.50$, it may become difficult to obtain the Fe-based nanocrystal alloy by the heat treatment.

Note that, the soft magnetic alloy according to the present embodiment may include an element other than the above mentioned elements as an inevitable impurity. For example, 0.1 wt % or less may be included with respect to 100 wt % of the soft magnetic alloy.

Hereinafter, the method of producing the soft magnetic alloy according to the present embodiment will be described.

The method of producing the soft magnetic alloy according to the present embodiment is not particularly limited. For example, the method of producing a ribbon of the soft magnetic alloy according to the present embodiment by a single roll method may be mentioned. The ribbon may be a continuous ribbon.

As the single roll method, pure metals of each metal element which will be included in the soft magnetic alloy at the end are prepared, then these are weighed so that the same composition as the soft magnetic alloy obtained at the end is obtained. Then, the pure metals of each metal element are melted and mixed, thereby a base alloy is produced. Note that, the method of melting said pure metals is not particularly limited, and for example, the method of vacuuming inside the chamber, and then melting by a high-frequency heating may be mentioned. Note that, the base alloy and the soft magnetic alloy composed of the Fe-based nanocrystals obtained at the end usually has the same composition.

Next, the produced base alloy is heated and melted, thereby a molten metal is obtained. The temperature of the molten metal is not particularly limited, and for example it may be 1200 to 1500° C.

For the single roll method, the thickness of the ribbon to be obtained can be regulated mainly by regulating a rotating speed of a roll. However, the thickness of the ribbon to be obtained can be regulated also by regulating the space between a nozzle and a roll, and the temperature of the molten metal. The thickness of the ribbon is not particularly limited, but for example a thickness is 5 to 30 μm.

Prior to the heat treatment which will be described in below, the ribbon is the amorphous phase which does not include a crystal having the grain size larger than 30 nm. By carrying out the heat treatment which will be described in below to the ribbon of amorphous phase, the Fe-based nanocrystal alloy can be obtained.

Note that, the method of verifying the presence of the crystal having the grain size larger than 30 nm in the ribbon of the soft magnetic alloy before the heat treatment is not particularly limited. For example, the crystal having the grain size larger than 30 nm can be verified by a usual X-ray diffraction measurement.

Also, in the ribbon before the heat treatment, the initial fine crystal having the grain size of 15 nm or less may not be included at all, but preferably the initial fine crystal is included. That is, the ribbon before the heat treatment is preferably a nanohetero structure composed of the amorphous phase and the initial fine crystals present in the amorphous phase. Note that, the grain size of the initial fine crystal is not particularly limited, and preferably the average grain size is 0.3 to 10 nm.

Also, the method of verifying the average grain size and the presence of the above mentioned initial fine crystals are not particularly limited, and for example these may be verified by obtaining a restricted visual field diffraction image, a nano beam diffraction image, a bright field image, or a high resolution image using a transmission electron microscope to the sample thinned by ion milling or so. When using the restricted visual field diffraction image or the nano beam diffraction image, as the diffraction pattern, a ring form diffraction is formed in case of the amorphous phase, on the other hand a diffraction spots are formed which is caused by the crystal structure when it is not an amorphous phase. Also, when using the bright field image or the high resolution image, by visually observing at the magnification of $1.00 \times 10^5$ to $3.00 \times 10^5$, the presence of the initial fine crystals and the average grain size can be verified.

The temperature and the rotating speed of the roll and the atmosphere inside the chamber are not particularly limited. The temperature of the roll is preferably 4 to 30° C. for the amorphization. The faster the rotating speed of the roll is, the smaller the average grain size of the initial fine crystals tends to be. The rotating speed is preferably 25 to 30 m/sec from the point of obtaining the initial fine crystals having the average grain size of 0.3 to 10 nm. The atmosphere inside of the chamber is preferably air atmosphere considering the cost.

Also, the heat treating condition for producing the Fe-based nanocrystal alloy is not particularly limited. The more preferable heat treating condition differs depending on the composition of the soft magnetic alloy. Usually, the preferable heat treating condition is about 400 to 600° C., and preferable heat treating time is about 0.5 to 10 hours. However, depending on the composition, the preferable heat treating temperature and the heat treating time may be outside of the above mentioned ranges. Also, the atmosphere of the heat treatment is not particularly limited. The heat treatment may be carried out under active atmosphere such as air atmosphere, or under inert atmosphere such as Ar gas.

Also, the method of calculating the average grain size of the obtained Fe-based nanocrystal alloy is not particularly limited. For example, it can be calculated by an observation using a transmission electron microscope. Also, the method of verifying the crystal structure of bcc (body-centered cubic structure) is not particularly limited. For example, this can be verified using X-ray diffraction measurement.

Also, as the method of obtaining the soft magnetic alloy according to the present embodiment, besides the above mentioned single roll method, for example the method of obtaining the powder of the soft magnetic alloy according to the present embodiment by a water atomizing method or a gas atomizing method may be mentioned. Hereinafter, the gas atomizing method will be described.

In the gas atomizing method, the molten alloy having the temperature of 1200 to 1500° C. is obtained by the same method as the above mentioned single roll method. Then, said molten metal is sprayed in the chamber, thereby the powder is produced.

Here, the gas spray temperature is 4 to 30° C., and the vapor pressure inside the chamber is 1 hPa or less, thereby the above mentioned preferable hetero structure can be easily obtained.

After producing the powder using the gas atomizing method, by carrying out the heat treatment under the condition of 400 to 600° C. for 0.5 to 10 minutes, the diffusion of elements are facilitated while the powder is prevented from becoming a coarse powder due to the sintering of the powders with each other, a thermodynamic equilibrium can be attained in a short period of time, and a distortion or stress can be removed, thus the Fe-based soft magnetic alloy having the average grain size of 10 to 50 nm can be easily obtained.

Hereinabove, an embodiment of the present invention has been described, but the present invention is not to be limited to the above mentioned embodiment.

The shape of the soft magnetic alloy according to the present embodiment is not particularly limited. As mentioned in above, a ribbon form and a powder form may be mentioned as examples, but besides these, a block form or so may be mentioned as well.

The use of the soft magnetic alloy (the Fe-based nanocrystal alloy) according to the present embodiment is not particularly limited. For example, magnetic devices may be mentioned, and among these, particularly the magnetic cores may be mentioned. It can be suitably used as the magnetic core for inductors, particularly power inductors. The soft magnetic alloy according to the present embodiment can be suitably used for thin film inductors, and magnetic heads or so other than the magnetic cores.

Hereinafter, the method of obtaining the magnetic devices, particularly the magnetic core and the inductor from the soft magnetic alloy according to the present embodiment will be described, but the method of obtaining the magnetic devices, particularly the magnetic core and the inductor from the soft magnetic alloy according to the present embodiment is not limited thereto. Also, as the use of the magnetic core, transformers and motors or so may be mentioned besides the inductor.

As the method of obtaining the magnetic core from the soft magnetic alloy of the ribbon form, the method of laminating or winding the soft magnetic alloy of a ribbon form may be mentioned. In case of laminating the ribbon form soft magnetic alloy via an insulator, the magnetic core with even enhanced properties can be obtained.

As the method of obtaining the magnetic core from the powder form soft magnetic alloy, for example the method of mixing the binder appropriately and then molding may be mentioned. Also, before mixing the binder, by carrying out the oxidation treatment or an insulation coating to the powder surface, the specific resistance is improved and the magnetic core suitable for even higher frequency regions is obtained.

The method of molding is not particularly limited, and the press molding and the mold pressing or so may be mentioned. The type of binder is not particularly limited, and silicone resin may be mentioned as example. The mixing ratio between the soft magnetic alloy powder and the binder is not particularly limited. For example, 1 to 10 mass % of the binder is mixed with respect to 100 mass % of the soft magnetic alloy powder.

For example, 1 to 5 mass % of the binder is mixed with respect to 100 mass % of the soft magnetic alloy powder, then a compression molding is carried out, thereby the magnetic core having 70% or more of a space factor (a powder filling rate), and a magnetic flux density of 0.45 T or more and the specific resistance of 1 Ω·cm or more when applied with a magnetic field of $1.6\times10^4$ A/m can be obtained. The above mentioned properties are the properties same or more than the general ferrite magnetic core.

Also, for example, by mixing 1 to 3 mass % of the binder with respect to 100 mass % of the soft magnetic alloy powder, and carrying out the compression molding under the temperature at the softening point or higher of the binder, the dust core having 80% or more of a space factor, and a magnetic flux density of 0.9 T or more and the specific resistance of 0.1 Ω·cm or more when applied with a magnetic field of $1.6\times10^4$ A/m can be obtained. The above mentioned properties are excellent properties compared to the general dust core.

Further, by carrying out the heat treatment after the molding as a heat treatment for removing the distortion to the powder compact which forms the above mentioned magnetic core, the core loss is further decreased, and becomes even more useful. Note that, the core loss of the magnetic core decreases as the coercivity of the magnetic material constituting the magnetic core decreases.

Also, the inductance product is obtained by winding a wire around the above mentioned magnetic core. The method of winding the wire and the method of producing the inductance product are not particularly limited. For example, the method of winding at least 1 or more turns of wire around the magnetic core produced by the above mentioned method may be mentioned.

Further, in case of using the soft magnetic alloy particle, the method of press molding while the wire is incorporated in the magnetic material to integrate the wire and the magnetic material, thereby producing the inductance product may be mentioned. In this case, the inductance product corresponding to a high frequency and a large current is easily obtained.

Further, in case of using the soft magnetic alloy particle, a soft magnetic alloy paste which is made into a paste by adding the binder and a solvent to the soft magnetic alloy particle, and a conductor paste which is made into a paste by adding the binder and a solvent to a conductor metal for the coil are print laminated in an alternating manner, and fired; thereby the inductance product can be obtained. Alternatively, the soft magnetic alloy sheet is produced using the soft magnetic alloy paste, and the conductor paste is printed on the surface of the soft magnetic alloy sheet, then these are laminated and fired, thereby the inductance product wherein the coil is incorporated in the magnetic material can be obtained.

Here, in case of producing the inductance product using the soft magnetic alloy particle, in order to obtain an excellent Q property, the soft magnetic alloy powder having a maximum particle size of 45 μm or less by sieve diameter and a center particle size (D50) of 30 μm or less is preferably used. In order to have a maximum particle size of 45 μm or less by a sieve diameter, by using a sieve with a mesh size of 45 μm, only the soft magnetic alloy powder which passes through the sieve may be used.

The larger the maximum particle size of the used soft magnetic alloy powder is, the lower the Q value tends to be in a high frequency range, and in case of using the soft magnetic alloy powder of which the maximum particle size exceeds 45 μm by a sieve diameter, the Q value may greatly decrease in the high frequency range. However, if the Q value in the high frequency range is not important, the soft magnetic alloy powder having a large size variation can be used. The soft magnetic alloy powder with large size variation can be produced at relatively low cost, therefore in case of using the soft magnetic alloy powder having a large size variation, the cost can be reduced.

EXAMPLE

Hereinafter, the present invention will be described based on examples.

Metal materials were weighed so that the alloy compositions of each examples and comparative examples shown in below were satisfied, then melted by a high-frequency heating, thereby the base alloy was prepared.

Then, the prepared base alloy was heated and melted to obtain the molten metal at 1300° C., then said metal was sprayed to a roll by a single roll method which was used in the air atmosphere at 20° C. and rotating speed of 30 m/sec. Thereby, ribbons were formed. The ribbon had a thickness of 20 to 25 the width of about 15 mm, and the length of about 10 m.

The X-ray diffraction measurement was carried out to obtain each ribbon to verify the presence of the crystals having the grain size larger than 30 nm. Then, if the crystal having the grain size larger than 30 nm did not exist, then it was determined to be formed by the amorphous phase, and if crystals having the grain size larger than 30 nm did exist, then it was determined to be formed by the crystal phase. Note that, the amorphous phase may include the initial fine crystals having the grain size of 15 nm or less.

Then, the heat treatment was carried out by the condition shown in below to the ribbon of each example and comparative example. After the heat treatment was carried out to each ribbon, the saturation magnetic flux density, the coercivity, and the magnetic permeability were measured. The saturation magnetic flux density (Bs) was measured using a vibrating sample magnetometer (VSM) in a magnetic field of 1000 kA/m. The coercivity (Hc) was measured using a DC-BH tracer in a magnetic field of 5 kA/m. The magnetic permeability (μ') was measured using an impedance analyzer in a frequency of 1 kHz. In the present examples, the saturation magnetic flux density of 1.30 T or more was considered to be favorable, and the saturation magnetic flux density of 1.45 T or more was considered to be more favorable. In the present examples, the coercivity of 3.0 A/m or less was considered to be favorable, the coercivity of 2.5 A/m or less was considered to be more favorable. The magnetic permeability μ' of 50000 or more was considered favorable, 54000 or more was considered more favorable.

Note that, in the examples shown in below, unless mentioned otherwise, the observation using an X-ray diffraction measurement and a transmission electron microscope verified that all examples shown in below had Fe-based nanocrystals having the average grain size of 5 to 30 nm and the crystal structure of bcc.

TABLE 1

| | $Fe_{(1-(a+b+c))}M_aB_bP_c$ ($\alpha = \beta = 0$) | | | | | | | | | | | | | |
|---|---|---|---|---|---|---|---|---|---|---|---|---|---|---|
| Sample No. | Fe | Nb | Hf a | Zr | B b | P c | C (wt %) | S (wt %) | C/S | Ti (wt %) | XRD | Bs (T) | Hc (A/m) | μ' (1 kHz) |
| Example 1 | 0.880 | 0.020 | 0.000 | 0.000 | 0.100 | 0.000 | 0.001 | 0.001 | 1.00 | 0.001 | amorphous phase | 1.54 | 2.0 | 53000 |
| Example 2 | 0.830 | 0.070 | 0.000 | 0.000 | 0.100 | 0.000 | 0.001 | 0.001 | 1.00 | 0.001 | amorphous phase | 1.45 | 2.5 | 52700 |
| Example 3 | 0.760 | 0.140 | 0.000 | 0.000 | 0.100 | 0.000 | 0.001 | 0.001 | 1.00 | 0.001 | amorphous phase | 1.44 | 2.9 | 51200 |
| Example 4 | 0.910 | 0.070 | 0.000 | 0.000 | 0.020 | 0.000 | 0.001 | 0.001 | 1.00 | 0.001 | amorphous phase | 1.72 | 2.3 | 51500 |
| Example 2 | 0.830 | 0.070 | 0.000 | 0.000 | 0.100 | 0.000 | 0.001 | 0.001 | 1.00 | 0.001 | amorphous phase | 1.45 | 2.5 | 52700 |
| Example 5 | 0.730 | 0.070 | 0.000 | 0.000 | 0.200 | 0.000 | 0.001 | 0.001 | 1.00 | 0.001 | amorphous phase | 1.34 | 2.8 | 51200 |
| Example 6 | 0.880 | 0.020 | 0.000 | 0.000 | 0.100 | 0.000 | 0.010 | 0.010 | 1.00 | 0.010 | amorphous phase | 1.56 | 2.1 | 53700 |
| Example 7 | 0.830 | 0.070 | 0.000 | 0.000 | 0.100 | 0.000 | 0.010 | 0.010 | 1.00 | 0.010 | amorphous phase | 1.50 | 2.4 | 53800 |
| Example 8 | 0.760 | 0.140 | 0.000 | 0.000 | 0.100 | 0.000 | 0.010 | 0.010 | 1.00 | 0.010 | amorphous phase | 1.42 | 2.9 | 50800 |
| Example 9 | 0.910 | 0.070 | 0.000 | 0.000 | 0.020 | 0.000 | 0.010 | 0.010 | 1.00 | 0.010 | amorphous phase | 1.74 | 2.1 | 53900 |
| Example 7 | 0.830 | 0.070 | 0.000 | 0.000 | 0.100 | 0.000 | 0.010 | 0.010 | 1.00 | 0.010 | amorphous phase | 1.50 | 2.4 | 53800 |
| Example 10 | 0.730 | 0.070 | 0.000 | 0.000 | 0.200 | 0.000 | 0.010 | 0.010 | 1.00 | 0.010 | amorphous phase | 1.35 | 2.7 | 51100 |
| Example 11 | 0.880 | 0.020 | 0.000 | 0.000 | 0.100 | 0.000 | 0.050 | 0.050 | 1.00 | 0.050 | amorphous phase | 1.52 | 2.4 | 53200 |
| Example 12 | 0.830 | 0.070 | 0.000 | 0.000 | 0.100 | 0.000 | 0.050 | 0.050 | 1.00 | 0.050 | amorphous phase | 1.45 | 2.7 | 52600 |
| Example 13 | 0.760 | 0.140 | 0.000 | 0.000 | 0.100 | 0.000 | 0.050 | 0.050 | 1.00 | 0.050 | amorphous phase | 1.41 | 2.9 | 51000 |
| Example 14 | 0.910 | 0.070 | 0.000 | 0.000 | 0.020 | 0.000 | 0.050 | 0.050 | 1.00 | 0.050 | amorphous phase | 1.74 | 2.4 | 52200 |

TABLE 1-continued

| | $Fe_{(1-(a+b+c))}M_aB_bP_c$ ($\alpha = \beta = 0$) | | | | | | | | | | | | | |
|---|---|---|---|---|---|---|---|---|---|---|---|---|---|---|
| Sample No. | Fe | Nb | Hf a | Zr | B b | P c | C (wt %) | S (wt %) | C/S | Ti (wt %) | XRD | Bs (T) | Hc (A/m) | μ' (1 kHz) |
| Example 12 | 0.830 | 0.070 | 0.000 | 0.000 | 0.100 | 0.000 | 0.050 | 0.050 | 1.00 | 0.050 | amorphous phase | 1.45 | 2.7 | 52600 |
| Example 15 | 0.730 | 0.070 | 0.000 | 0.000 | 0.200 | 0.000 | 0.050 | 0.050 | 1.00 | 0.050 | amorphous phase | 1.32 | 2.7 | 51200 |

TABLE 2

| | $Fe_{(1-(a+b+c))}M_aB_bP_c$ ($\alpha = \beta = 0$) | | | | | | | | | | | | | |
|---|---|---|---|---|---|---|---|---|---|---|---|---|---|---|
| Sample No. | Fe | Nb | Hf a | Zr | B b | P c | C (wt %) | S (wt %) | C/S | Ti (wt %) | XRD | Bs (T) | Hc (A/m) | μ' (1 kHz) |
| Comparative example 1 | 0.880 | 0.020 | 0.000 | 0.000 | 0.100 | 0.000 | 0.000 | 0.000 | — | 0.000 | crystal phase | 1.54 | 387 | 832 |
| Comparative example 2 | 0.830 | 0.070 | 0.000 | 0.000 | 0.100 | 0.000 | 0.000 | 0.000 | — | 0.000 | amorphous phase | 1.46 | 8.3 | 33300 |
| Comparative example 3 | 0.760 | 0.140 | 0.000 | 0.000 | 0.100 | 0.000 | 0.000 | 0.000 | — | 0.000 | amorphous phase | 1.42 | 8.8 | 31400 |
| Comparative example 4 | 0.910 | 0.070 | 0.000 | 0.000 | 0.020 | 0.000 | 0.000 | 0.000 | — | 0.000 | amorphous phase | 1.70 | 7.1 | 32600 |
| Comparative example 5 | 0.730 | 0.070 | 0.000 | 0.000 | 0.200 | 0.000 | 0.000 | 0.000 | — | 0.000 | amorphous phase | 1.39 | 7.5 | 31100 |
| Comparative example 6 | 0.830 | 0.070 | 0.000 | 0.000 | 0.100 | 0.000 | 0.001 | 0.000 | — | 0.000 | amorphous phase | 1.44 | 5.3 | 37300 |
| Comparative example 7 | 0.830 | 0.070 | 0.000 | 0.000 | 0.100 | 0.000 | 0.050 | 0.000 | — | 0.000 | amorphous phase | 1.42 | 5.1 | 39200 |
| Comparative example 8 | 0.830 | 0.070 | 0.000 | 0.000 | 0.100 | 0.000 | 0.000 | 0.001 | 0.00 | 0.000 | amorphous phase | 1.43 | 5.8 | 35500 |
| Comparative example 9 | 0.830 | 0.070 | 0.000 | 0.000 | 0.100 | 0.000 | 0.000 | 0.050 | 0.00 | 0.000 | amorphous phase | 1.41 | 5.2 | 39300 |
| Comparative example 10 | 0.830 | 0.070 | 0.000 | 0.000 | 0.100 | 0.000 | 0.000 | 0.000 | — | 0.001 | amorphous phase | 1.47 | 5.8 | 39100 |
| Comparative example 11 | 0.830 | 0.070 | 0.000 | 0.000 | 0.100 | 0.000 | 0.000 | 0.000 | — | 0.080 | amorphous phase | 1.41 | 5.4 | 36500 |
| Comparative example 12 | 0.830 | 0.070 | 0.000 | 0.000 | 0.100 | 0.000 | 0.001 | 0.001 | 1.00 | 0.000 | amorphous phase | 1.50 | 4.1 | 42200 |
| Comparative example 13 | 0.830 | 0.070 | 0.000 | 0.000 | 0.100 | 0.000 | 0.050 | 0.050 | 1.00 | 0.000 | amorphous phase | 1.49 | 4.0 | 43100 |
| Comparative example 14 | 0.830 | 0.070 | 0.000 | 0.000 | 0.100 | 0.000 | 0.000 | 0.001 | 0.00 | 0.001 | amorphous phase | 1.53 | 4.0 | 41400 |
| Comparative example 15 | 0.830 | 0.070 | 0.000 | 0.000 | 0.100 | 0.000 | 0.000 | 0.050 | 0.00 | 0.080 | amorphous phase | 1.51 | 4.0 | 42400 |
| Comparative example 16 | 0.830 | 0.070 | 0.000 | 0.000 | 0.100 | 0.000 | 0.001 | 0.000 | — | 0.001 | amorphous phase | 1.46 | 4.6 | 43800 |
| Comparative example 17 | 0.830 | 0.070 | 0.000 | 0.000 | 0.100 | 0.000 | 0.050 | 0.000 | — | 0.080 | amorphous phase | 1.45 | 4.5 | 44600 |
| Comparative example 18 | 0.940 | 0.020 | 0.000 | 0.000 | 0.040 | 0.000 | 0.010 | 0.000 | — | 0.000 | crystal phase | 1.74 | 247 | 882 |
| Comparative example 19 | 0.940 | 0.020 | 0.000 | 0.000 | 0.040 | 0.000 | 0.000 | 0.010 | — | 0.000 | crystal phase | 1.74 | 382 | 582 |
| Comparative example 20 | 0.940 | 0.020 | 0.000 | 0.000 | 0.040 | 0.000 | 0.000 | 0.000 | — | 0.010 | crystal phase | 1.72 | 407 | 229 |
| Example 16 | 0.940 | 0.020 | 0.000 | 0.000 | 0.040 | 0.000 | 0.010 | 0.010 | 1.00 | 0.010 | amorphous phase | 1.78 | 2.9 | 50900 |

TABLE 3

| | $Fe_{(1-(a+b+c))}M_aB_bP_c$ ($\alpha = \beta = 0$) | | | | | | | | | | | | | |
|---|---|---|---|---|---|---|---|---|---|---|---|---|---|---|
| Sample No. | Fe | Nb | Hf a | Zr | B b | P c | C (wt %) | S (wt %) | C/S | Ti (wt %) | XRD | Bs (T) | Hc (A/m) | μ' (1 kHz) |
| Comparative example 21 | 0.882 | 0.018 | 0.000 | 0.000 | 0.100 | 0.000 | 0.010 | 0.005 | 2.00 | 0.010 | crystal phase | 1.52 | 219 | 903 |
| Example 17 | 0.880 | 0.020 | 0.000 | 0.000 | 0.100 | 0.000 | 0.010 | 0.005 | 2.00 | 0.010 | amorphous phase | 1.58 | 2.1 | 53800 |

TABLE 3-continued

| | $Fe_{(1-(a+b+c))}M_aB_bP_c$ ($\alpha = \beta = 0$) | | | | | | | | | | | | | |
|---|---|---|---|---|---|---|---|---|---|---|---|---|---|---|
| Sample No. | Fe | Nb | Hf a | Zr | B b | P c | C (wt %) | S (wt %) | C/S | Ti (wt %) | XRD | Bs (T) | Hc (A/m) | μ' (1 kHz) |
| Example 18 | 0.850 | 0.050 | 0.000 | 0.000 | 0.100 | 0.000 | 0.010 | 0.005 | 2.00 | 0.010 | amorphous phase | 1.54 | 2.3 | 53600 |
| Example 19 | 0.830 | 0.070 | 0.000 | 0.000 | 0.100 | 0.000 | 0.010 | 0.005 | 2.00 | 0.010 | amorphous phase | 1.51 | 2.4 | 53500 |
| Example 20 | 0.800 | 0.100 | 0.000 | 0.000 | 0.100 | 0.000 | 0.010 | 0.005 | 2.00 | 0.010 | amorphous phase | 1.47 | 2.5 | 52300 |
| Example 21 | 0.780 | 0.120 | 0.000 | 0.000 | 0.100 | 0.000 | 0.010 | 0.005 | 2.00 | 0.010 | amorphous phase | 1.42 | 2.7 | 52900 |
| Example 22 | 0.760 | 0.140 | 0.000 | 0.000 | 0.100 | 0.000 | 0.010 | 0.005 | 2.00 | 0.010 | amorphous phase | 1.40 | 2.9 | 51100 |
| Comparative example 22 | 0.750 | 0.150 | 0.000 | 0.000 | 0.100 | 0.000 | 0.010 | 0.005 | 2.00 | 0.010 | amorphous phase | 1.26 | 3.0 | 50100 |

TABLE 4

| | $Fe_{(1-(a+b+c))}M_aB_bP_c$ ($\alpha = \beta = 0$) | | | | | | | | | | | | | |
|---|---|---|---|---|---|---|---|---|---|---|---|---|---|---|
| Sample No. | Fe | Nb | Hf a | Zr | B b | P c | C (wt %) | S (wt %) | C/S | Ti (wt %) | XRD | Bs (T) | Hc (A/m) | μ' (1 kHz) |
| Example 17 | 0.880 | 0.020 | 0.000 | 0.000 | 0.100 | 0.000 | 0.010 | 0.005 | 2.00 | 0.010 | amorphous phase | 1.58 | 2.1 | 53800 |
| Example 23 | 0.880 | 0.000 | 0.020 | 0.000 | 0.100 | 0.000 | 0.010 | 0.005 | 2.00 | 0.010 | amorphous phase | 1.55 | 2.1 | 53900 |
| Example 24 | 0.880 | 0.000 | 0.000 | 0.020 | 0.100 | 0.000 | 0.010 | 0.005 | 2.00 | 0.010 | amorphous phase | 1.56 | 2.1 | 53700 |
| Example 19 | 0.830 | 0.070 | 0.000 | 0.000 | 0.100 | 0.000 | 0.010 | 0.005 | 2.00 | 0.010 | amorphous phase | 1.51 | 2.4 | 53500 |
| Example 25 | 0.830 | 0.000 | 0.070 | 0.000 | 0.100 | 0.000 | 0.010 | 0.005 | 2.00 | 0.010 | amorphous phase | 1.51 | 2.5 | 53100 |
| Example 26 | 0.830 | 0.000 | 0.000 | 0.070 | 0.100 | 0.000 | 0.010 | 0.005 | 2.00 | 0.010 | amorphous phase | 1.52 | 2.5 | 52700 |
| Example 22 | 0.760 | 0.140 | 0.000 | 0.000 | 0.100 | 0.000 | 0.010 | 0.005 | 2.00 | 0.010 | amorphous phase | 1.40 | 2.9 | 51100 |
| Example 27 | 0.760 | 0.000 | 0.140 | 0.000 | 0.100 | 0.000 | 0.010 | 0.005 | 2.00 | 0.010 | amorphous phase | 1.43 | 3.0 | 50600 |
| Example 28 | 0.760 | 0.000 | 0.000 | 0.140 | 0.100 | 0.000 | 0.010 | 0.005 | 2.00 | 0.010 | amorphous phase | 1.43 | 3.0 | 50300 |
| Example 29 | 0.880 | 0.010 | 0.010 | 0.000 | 0.100 | 0.000 | 0.010 | 0.005 | 2.00 | 0.010 | amorphous phase | 1.55 | 2.2 | 53700 |
| Example 30 | 0.880 | 0.010 | 0.000 | 0.010 | 0.100 | 0.000 | 0.010 | 0.005 | 2.00 | 0.010 | amorphous phase | 1.54 | 2.1 | 53800 |
| Example 31 | 0.880 | 0.000 | 0.010 | 0.010 | 0.100 | 0.000 | 0.010 | 0.005 | 2.00 | 0.010 | amorphous phase | 1.54 | 2.2 | 53500 |
| Example 32 | 0.880 | 0.007 | 0.007 | 0.006 | 0.100 | 0.000 | 0.010 | 0.005 | 2.00 | 0.010 | amorphous phase | 1.56 | 2.2 | 53600 |
| Example 33 | 0.760 | 0.070 | 0.070 | 0.000 | 0.100 | 0.000 | 0.010 | 0.005 | 2.00 | 0.010 | amorphous phase | 1.44 | 2.9 | 50200 |
| Example 34 | 0.760 | 0.070 | 0.000 | 0.070 | 0.100 | 0.000 | 0.010 | 0.005 | 2.00 | 0.010 | amorphous phase | 1.43 | 3.0 | 50500 |
| Example 35 | 0.760 | 0.000 | 0.070 | 0.070 | 0.100 | 0.000 | 0.010 | 0.005 | 2.00 | 0.010 | amorphous phase | 1.42 | 2.8 | 51300 |
| Example 36 | 0.760 | 0.050 | 0.050 | 0.040 | 0.100 | 0.000 | 0.010 | 0.005 | 2.00 | 0.010 | amorphous phase | 1.41 | 3.0 | 51000 |
| Comparative example 21 | 0.882 | 0.018 | 0.000 | 0.000 | 0.100 | 0.000 | 0.010 | 0.005 | 2.00 | 0.010 | crystal phase | 1.52 | 219 | 903 |
| Comparative example 23 | 0.882 | 0.006 | 0.006 | 0.006 | 0.100 | 0.000 | 0.010 | 0.005 | 2.00 | 0.010 | crystal phase | 1.51 | 328 | 338 |
| Comparative example 22 | 0.750 | 0.150 | 0.000 | 0.000 | 0.100 | 0.000 | 0.010 | 0.005 | 2.00 | 0.010 | amorphous phase | 1.28 | 3.0 | 50100 |
| Comparative example 24 | 0.750 | 0.050 | 0.050 | 0.050 | 0.100 | 0.000 | 0.010 | 0.005 | 2.00 | 0.010 | amorphous phase | 1.24 | 3.4 | 47200 |

TABLE 5

| Sample No. | $Fe_{(1-(a+b+c))}M_aB_bP_c$ ($\alpha = \beta = 0$) Fe | Nb | Hf a | Zr | B b | P c | C (wt %) | S (wt %) | C/S | Ti (wt %) | XRD | Bs (T) | Hc (A/m) | μ' (1 kHz) |
|---|---|---|---|---|---|---|---|---|---|---|---|---|---|---|
| Comparative example 25 | 0.912 | 0.070 | 0.000 | 0.000 | 0.018 | 0.000 | 0.010 | 0.005 | 2.00 | 0.010 | crystal phase | 1.68 | 223 | 682 |
| Example 37 | 0.910 | 0.070 | 0.000 | 0.000 | 0.020 | 0.000 | 0.010 | 0.005 | 2.00 | 0.010 | amorphous phase | 1.71 | 2.1 | 53800 |
| Example 38 | 0.890 | 0.070 | 0.000 | 0.000 | 0.040 | 0.000 | 0.010 | 0.005 | 2.00 | 0.010 | amorphous phase | 1.63 | 2.2 | 53700 |
| Example 39 | 0.860 | 0.070 | 0.000 | 0.000 | 0.070 | 0.000 | 0.010 | 0.005 | 2.00 | 0.010 | amorphous phase | 1.55 | 2.4 | 53600 |
| Example 19 | 0.830 | 0.070 | 0.000 | 0.000 | 0.100 | 0.000 | 0.010 | 0.005 | 2.00 | 0.010 | amorphous phase | 1.51 | 2.4 | 53500 |
| Example 40 | 0.790 | 0.070 | 0.000 | 0.000 | 0.140 | 0.000 | 0.010 | 0.005 | 2.00 | 0.010 | amorphous phase | 1.45 | 2.5 | 53600 |
| Example 41 | 0.750 | 0.070 | 0.000 | 0.000 | 0.180 | 0.000 | 0.010 | 0.005 | 2.00 | 0.010 | amorphous phase | 1.36 | 2.5 | 53200 |
| Example 42 | 0.730 | 0.070 | 0.000 | 0.000 | 0.200 | 0.000 | 0.010 | 0.005 | 2.00 | 0.010 | amorphous phase | 1.33 | 2.7 | 52500 |
| Comparative example 26 | 0.710 | 0.070 | 0.000 | 0.000 | 0.220 | 0.000 | 0.010 | 0.005 | 2.00 | 0.010 | amorphous phase | 1.17 | 2.8 | 51100 |

TABLE 6

| Sample No. | $Fe_{(1-(a+b+c))}M_aB_bP_c$ ($\alpha = \beta = 0$) Fe | Nb | Hf a | Zr | B b | P c | C (wt %) | S (wt %) | C/S | Ti (wt %) | XRD | Bs (T) | Hc (A/m) | μ' (1 kHz) |
|---|---|---|---|---|---|---|---|---|---|---|---|---|---|---|
| Comparative example 27 | 0.830 | 0.070 | 0.000 | 0.000 | 0.100 | 0.000 | 0.000 | 0.010 | 0.00 | 0.010 | amorphous phase | 1.51 | 4.7 | 44300 |
| Example 43 | 0.830 | 0.070 | 0.000 | 0.000 | 0.100 | 0.000 | 0.001 | 0.010 | 0.10 | 0.010 | amorphous phase | 1.47 | 2.7 | 53200 |
| Example 44 | 0.830 | 0.070 | 0.000 | 0.000 | 0.100 | 0.000 | 0.005 | 0.010 | 0.50 | 0.010 | amorphous phase | 1.49 | 2.5 | 53500 |
| Example 7 | 0.830 | 0.070 | 0.000 | 0.000 | 0.100 | 0.000 | 0.010 | 0.010 | 1.00 | 0.010 | amorphous phase | 1.50 | 2.4 | 53800 |
| Example 45 | 0.830 | 0.070 | 0.000 | 0.000 | 0.100 | 0.000 | 0.020 | 0.010 | 2.00 | 0.010 | amorphous phase | 1.50 | 2.2 | 52900 |
| Example 46 | 0.830 | 0.070 | 0.000 | 0.000 | 0.100 | 0.000 | 0.040 | 0.010 | 4.00 | 0.010 | amorphous phase | 1.51 | 2.5 | 53300 |
| Example 47 | 0.830 | 0.070 | 0.000 | 0.000 | 0.100 | 0.000 | 0.050 | 0.010 | 5.00 | 0.010 | amorphous phase | 1.52 | 2.7 | 50800 |
| Comparative example 28 | 0.830 | 0.070 | 0.000 | 0.000 | 0.100 | 0.000 | 0.070 | 0.010 | 7.00 | 0.010 | amorphous phase | 1.44 | 3.6 | 47700 |
| Comparative example 29 | 0.830 | 0.070 | 0.000 | 0.000 | 0.100 | 0.000 | 0.010 | 0.000 | — | 0.010 | amorphous phase | 1.50 | 5.1 | 41600 |
| Example 48 | 0.830 | 0.070 | 0.000 | 0.000 | 0.100 | 0.000 | 0.010 | 0.001 | 10.00 | 0.010 | amorphous phase | 1.50 | 2.9 | 52200 |
| Example 19 | 0.830 | 0.070 | 0.000 | 0.000 | 0.100 | 0.000 | 0.010 | 0.005 | 2.00 | 0.010 | amorphous phase | 1.51 | 2.4 | 53500 |
| Example 7 | 0.830 | 0.070 | 0.000 | 0.000 | 0.100 | 0.000 | 0.010 | 0.010 | 1.00 | 0.010 | amorphous phase | 1.50 | 2.4 | 53800 |
| Example 49 | 0.830 | 0.070 | 0.000 | 0.000 | 0.100 | 0.000 | 0.010 | 0.020 | 0.50 | 0.010 | amorphous phase | 1.49 | 2.5 | 53600 |
| Example 50 | 0.830 | 0.070 | 0.000 | 0.000 | 0.100 | 0.000 | 0.010 | 0.040 | 0.25 | 0.010 | amorphous phase | 1.47 | 2.5 | 53500 |
| Example 51 | 0.830 | 0.070 | 0.000 | 0.000 | 0.100 | 0.000 | 0.010 | 0.050 | 0.20 | 0.010 | amorphous phase | 1.46 | 2.7 | 52900 |
| Comparative example 30 | 0.830 | 0.070 | 0.000 | 0.000 | 0.100 | 0.000 | 0.010 | 0.070 | 0.14 | 0.010 | amorphous phase | 1.44 | 3.9 | 50800 |
| Comparative example 31 | 0.830 | 0.070 | 0.000 | 0.000 | 0.100 | 0.000 | 0.003 | 0.040 | 0.08 | 0.010 | amorphous phase | 1.46 | 4.3 | 48200 |
| Comparative example 32 | 0.830 | 0.070 | 0.000 | 0.000 | 0.100 | 0.000 | 0.023 | 0.002 | 11.5 | 0.010 | amorphous phase | 1.47 | 4.0 | 49800 |

TABLE 7

| | $Fe_{(1-(a+b+c))}M_aB_bP_c$ ($\alpha = \beta = 0$) | | | | | | | | | | | | | |
|---|---|---|---|---|---|---|---|---|---|---|---|---|---|---|
| Sample No. | Fe | Nb | Hf a | Zr | B b | P c | C (wt %) | S (wt %) | C/S | Ti (wt %) | XRD | Bs (T) | Hc (A/m) | μ' (1 kHz) |
| Comparative example 33 | 0.830 | 0.070 | 0.000 | 0.000 | 0.100 | 0.000 | 0.010 | 0.005 | 2.00 | 0.000 | amophous phase | 1.49 | 4.5 | 40700 |
| Example 52 | 0.830 | 0.070 | 0.000 | 0.000 | 0.100 | 0.000 | 0.010 | 0.005 | 2.00 | 0.001 | amophous phase | 1.48 | 2.7 | 52100 |
| Example 53 | 0.830 | 0.070 | 0.000 | 0.000 | 0.100 | 0.000 | 0.010 | 0.005 | 2.00 | 0.005 | amophous phase | 1.50 | 2.5 | 52500 |
| Example 19 | 0.830 | 0.070 | 0.000 | 0.000 | 0.100 | 0.000 | 0.010 | 0.005 | 2.00 | 0.010 | amophous phase | 1.51 | 2.4 | 53500 |
| Example 54 | 0.830 | 0.070 | 0.000 | 0.000 | 0.100 | 0.000 | 0.010 | 0.005 | 2.00 | 0.020 | amophous phase | 1.49 | 2.4 | 53100 |
| Example 55 | 0.830 | 0.070 | 0.000 | 0.000 | 0.100 | 0.000 | 0.010 | 0.005 | 2.00 | 0.040 | amophous phase | 1.47 | 2.5 | 52900 |
| Example 56 | 0.830 | 0.070 | 0.000 | 0.000 | 0.100 | 0.000 | 0.010 | 0.005 | 2.00 | 0.060 | amophous phase | 1.46 | 2.8 | 51700 |
| Example 57 | 0.830 | 0.070 | 0.000 | 0.000 | 0.100 | 0.000 | 0.010 | 0.005 | 2.00 | 0.080 | amophous phase | 1.44 | 2.9 | 50900 |
| Comparative example 34 | 0.830 | 0.070 | 0.000 | 0.000 | 0.100 | 0.000 | 0.010 | 0.005 | 2.00 | 0.100 | amophous phase | 1.43 | 4.6 | 40200 |

TABLE 8

| | $Fe_{(1-(a+b+c))}M_aB_bP_c$ ($\alpha = \beta = 0$) | | | | | | | | | | | | | |
|---|---|---|---|---|---|---|---|---|---|---|---|---|---|---|
| Sample No. | Fe | Nb | Hf a | Zr | B b | P c | C (wt %) | S (wt %) | C/S | Ti (wt %) | XRD | Bs (T) | Hc (A/m) | μ' (1 kHz) |
| Example 19 | 0.830 | 0.070 | 0.000 | 0.000 | 0.100 | 0.000 | 0.010 | 0.005 | 2.00 | 0.010 | amorphous phase | 1.51 | 2.4 | 53500 |
| Example 58 | 0.829 | 0.070 | 0.000 | 0.000 | 0.100 | 0.001 | 0.010 | 0.005 | 2.00 | 0.010 | amorphous phase | 1.50 | 2.4 | 54500 |
| Example 59 | 0.825 | 0.070 | 0.000 | 0.000 | 0.100 | 0.005 | 0.010 | 0.005 | 2.00 | 0.010 | amorphous phase | 1.51 | 2.2 | 55100 |
| Example 60 | 0.820 | 0.070 | 0.000 | 0.000 | 0.100 | 0.010 | 0.010 | 0.005 | 2.00 | 0.010 | amorphous phase | 1.50 | 2.0 | 55300 |
| Example 61 | 0.810 | 0.070 | 0.000 | 0.000 | 0.100 | 0.020 | 0.010 | 0.005 | 2.00 | 0.010 | amorphous phase | 1.48 | 2.0 | 54800 |
| Example 62 | 0.790 | 0.070 | 0.000 | 0.000 | 0.100 | 0.040 | 0.010 | 0.005 | 2.00 | 0.010 | amorphous phase | 1.44 | 2.4 | 54200 |
| Comparative example 35 | 0.785 | 0.070 | 0.000 | 0.000 | 0.100 | 0.045 | 0.010 | 0.005 | 2.00 | 0.010 | crystal phase | 1.43 | 189 | 827 |

TABLE 9

| | $Fe_{(1-(a+b+c))}M_aB_bP_c$ ($\alpha = \beta = 0$) | | | | | | | | | | | | | |
|---|---|---|---|---|---|---|---|---|---|---|---|---|---|---|
| Sample No. | Fe | Nb | Hf a | Zr | B b | P c | C (wt %) | S (wt %) | C/S | Ti (wt %) | XRD | Bs (T) | Hc (A/m) | μ' (1 kHz) |
| Example 60 | 0.820 | 0.070 | 0.000 | 0.000 | 0.100 | 0.010 | 0.010 | 0.005 | 2.00 | 0.010 | amorphous phase | 1.50 | 2.0 | 55300 |
| Example 63 | 0.940 | 0.020 | 0.000 | 0.000 | 0.030 | 0.010 | 0.010 | 0.005 | 2.00 | 0.010 | amorphous phase | 1.77 | 2.5 | 54100 |
| Example 62 | 0.790 | 0.070 | 0.000 | 0.000 | 0.100 | 0.040 | 0.010 | 0.005 | 2.00 | 0.010 | amorphous phase | 1.44 | 2.4 | 54200 |
| Example 64 | 0.910 | 0.020 | 0.000 | 0.000 | 0.030 | 0.040 | 0.010 | 0.005 | 2.00 | 0.010 | amorphous phase | 1.73 | 2.4 | 54400 |
| Example 65 | 0.879 | 0.020 | 0.000 | 0.000 | 0.100 | 0.001 | 0.010 | 0.005 | 2.00 | 0.010 | amorphous phase | 1.61 | 2.4 | 54300 |
| Example 58 | 0.829 | 0.070 | 0.000 | 0.000 | 0.100 | 0.001 | 0.010 | 0.005 | 2.00 | 0.010 | amorphous phase | 1.50 | 2.4 | 54500 |
| Example 66 | 0.759 | 0.140 | 0.000 | 0.000 | 0.100 | 0.001 | 0.010 | 0.005 | 2.00 | 0.010 | amorphous phase | 1.38 | 2.5 | 54100 |
| Example 67 | 0.840 | 0.020 | 0.000 | 0.000 | 0.100 | 0.040 | 0.010 | 0.005 | 2.00 | 0.010 | amorphous phase | 1.55 | 2.3 | 55000 |

TABLE 9-continued

| | $Fe_{(1-(a+b+c))}M_aB_bP_c$ ($\alpha = \beta = 0$) | | | | | | | | | | | | | |
|---|---|---|---|---|---|---|---|---|---|---|---|---|---|---|
| Sample No. | Fe | Nb | Hf a | Zr | B b | P c | C (wt %) | S (wt %) | C/S | Ti (wt %) | XRD | Bs (T) | Hc (A/m) | μ' (1 kHz) |
| Example 62 | 0.790 | 0.070 | 0.000 | 0.000 | 0.100 | 0.040 | 0.010 | 0.005 | 2.00 | 0.010 | amorphous phase | 1.44 | 2.4 | 54200 |
| Example 68 | 0.720 | 0.140 | 0.000 | 0.000 | 0.100 | 0.040 | 0.010 | 0.005 | 2.00 | 0.010 | amorphous phase | 1.33 | 2.4 | 54500 |

TABLE 10

| | a to c, C, S, Ti, α, and β are same as Example 19 | | | | |
|---|---|---|---|---|---|
| Sample No. | Mo | XRD | Bs (T) | Hc (A/m) | μ' (1 kHz) |
| Example 19 | Nb | amorphous phase | 1.51 | 2.4 | 53500 |
| Example 19a | Hf | amorphous phase | 1.53 | 2.4 | 53300 |
| Example 19b | Zr | amorphous phase | 1.53 | 2.4 | 53500 |
| Example 19c | Ta | amorphous phase | 1.51 | 2.3 | 53900 |

TABLE 10-continued

| | a to c, C, S, Ti, α, and β are same as Example 19 | | | | |
|---|---|---|---|---|---|
| Sample No. | Mo | XRD | Bs (T) | Hc (A/m) | μ' (1 kHz) |
| Example 19d | Mo | amorphous phase | 1.52 | 2.4 | 53400 |
| Example 19e | W | amorphous phase | 1.50 | 2.3 | 53700 |
| Example 19f | V | amorphous phase | 1.51 | 2.3 | 53600 |

TABLE 11

| | $Fe_{(1-(\alpha+\beta))}X1_\alpha X2_\beta$ (a to c, C, S, and Ti are same as Example 16) | | | | | | | |
|---|---|---|---|---|---|---|---|---|
| | X1 | | X2 | | | Bs | Hc | |
| Sample No. | Type | $\alpha\{1-(a+b+c)\}$ | Type | $\beta\{1-(a+b+c)\}$ | XRD | (T) | (A/m) | μ' (1 kHz) |
| Example 16 | — | 0.000 | — | 0.000 | amorphous phase | 1.78 | 2.9 | 50900 |
| Exmaple 69 | Co | 0.010 | — | 0.000 | amorphous phase | 1.78 | 2.9 | 50800 |
| Example 70 | Co | 0.100 | — | 0.000 | amorphous phase | 1.79 | 3.0 | 50100 |
| Example 71 | Co | 0.400 | — | 0.000 | amorphous phase | 1.80 | 3.0 | 50200 |
| Example 72 | Ni | 0.010 | — | 0.000 | amorphous phase | 1.77 | 2.9 | 50700 |
| Example 73 | Ni | 0.100 | — | 0.000 | amorphous phase | 1.75 | 2.9 | 50800 |
| Example 74 | Ni | 0.400 | — | 0.000 | amorphous phase | 1.73 | 2.8 | 50900 |
| Example 75 | — | 0.000 | Al | 0.030 | amorphous phase | 1.76 | 2.8 | 50800 |
| Example 76 | — | 0.000 | Mn | 0.030 | amorphous phase | 1.75 | 2.9 | 50600 |
| Example 77 | — | 0.000 | Zr | 0.030 | amorphous phase | 1.77 | 2.9 | 50700 |
| Example 78 | — | 0.000 | Sn | 0.030 | amorphous phase | 1.77 | 2.9 | 50500 |
| Example 79 | — | 0.000 | Bi | 0.030 | amorphous phase | 1.75 | 3.0 | 50100 |
| Example 80 | — | 0.000 | Y | 0.030 | amorphous phase | 1.76 | 3.0 | 50300 |
| Example 81 | Co | 0.100 | Al | 0.030 | amorphous phase | 1.78 | 2.8 | 51000 |

TABLE 12

| Sample No. | Rotating speed of roll (m/sec) | Heat treating temperature (° C.) | Average grain size of initial fine crystal (nm) | Average grain size of Fe-based nanocrystal alloy (nm) | XRD | Bs (T) | Hc (A/m) | μ' (1 kHz) |
|---|---|---|---|---|---|---|---|---|
| | a to c, C, S, and Ti are same as Example 16 | | | | | | | |
| Example 82 | 55 | 450 | No initial fine crystal | 3 | amorphous phase | 1.61 | 3.0 | 50100 |
| Example 83 | 50 | 400 | 0.1 | 3 | amorphous phase | 1.63 | 3.0 | 50200 |
| Example 84 | 40 | 450 | 0.3 | 5 | amorphous phase | 1.72 | 2.9 | 50600 |
| Example 85 | 40 | 500 | 0.3 | 10 | amorphous phase | 1.75 | 2.9 | 50700 |
| Example 86 | 40 | 550 | 0.3 | 13 | amorphous phase | 1.76 | 2.8 | 50800 |
| Example 16 | 30 | 550 | 10.0 | 20 | amorphous phase | 1.78 | 2.9 | 50900 |
| Example 87 | 30 | 600 | 10.0 | 30 | amorphous phase | 1.80 | 2.9 | 50700 |
| Example 88 | 20 | 650 | 15.0 | 50 | amorphous phase | 1.81 | 3.0 | 50300 |

Table 1 shows the examples of which the content (a) of M and the content (b) of B were varied. Note that, the type of M was Nb.

The examples having the content of each component within the predetermined range all exhibited favorable saturation magnetic flux density, coercivity, and magnetic permeability μ'. Also, the examples of which satisfying 0.020≤a≤0.10 and 0.020≤b≤0.14 exhibited particularly favorable saturation magnetic flux density and coercivity.

Table 2 shows the comparative examples which do not include one or more of C, S, and Ti, except for the example 16.

The coercivity was too high and the magnetic permeability μ' was too low for comparative examples which do not include one or more selected from the group consisting of C, S, and Ti. Also, the comparative examples 18 to 20 having a=0.020 and the content (1−(a+b+c)) of Fe of 0.940 had a ribbon before the heat treatment composed of the crystal phase, and the coercivity significantly increased and the magnetic permeability significantly decreased after the heat treatment. On the other hand, even when (a) was 0.020, the comparative example 16 having all of C, S, and Ti had a ribbon before the heat treatment composed of the amorphous phase, and the sample having significantly large saturation magnetic flux density, a good coercivity, and a good magnetic permeability μ' was able to obtain by carrying out the heat treatment.

Table 3 shows the examples and comparative examples of which the content (a) of M was varied.

The examples satisfying 0.020≤a≤0.14 had favorable saturation magnetic flux density, coercivity, and magnetic permeability μ'. Also, the examples 17 to 20 satisfying 0.020≤a≤0.10 had particularly favorable saturation magnetic flux density and coercivity.

On the contrary to this, the comparative example having a=0.018 had a ribbon before the heat treatment composed of the crystal phase, and the coercivity after the heat treatment significantly increased and the magnetic permeability μ' significantly decreased. Also, the saturation magnetic flux density of the comparative example having a=0.15 was too low.

Table 4 shows the examples of which the type of M was varied. Even if the type of M was varied, the examples having the content of each element within the predetermined range exhibited favorable saturation magnetic flux density, coercivity, and magnetic permeability μ'. Also, the examples satisfying 0.020≤a≤0.10 had particularly favorable saturation magnetic flux density and coercivity.

Table 5 shows the examples and comparative examples varied with the content (b) of B.

The examples satisfying 0.020≤b≤0.20 had favorable saturation magnetic flux density, coercivity, and magnetic permeability μ'. Particularly, the examples satisfying 0.020≤b≤0.14 had particularly favorable saturation magnetic flux density and coercivity. On the contrary to this, the example having b=0.018 had a ribbon before the heat treatment composed of the crystal phase, and the coercivity after the heat treatment significantly increased and the magnetic permeability μ' significantly decreased. Also, the saturation magnetic flux density of the comparative example having b=0.220 was too small.

Table 6 shows the examples and the comparative examples of which the content of sub component C and S were varied.

The example satisfying the content of C of 0.001 to 0.050 wt %, the content of S of 0.001 to 0.050 wt %, and 0.10≤C/S≤10 exhibited favorable saturation magnetic flux density, coercivity, and magnetic permeability μ'. Particularly, the example satisfying the content of C of 0.005 to 0.040 wt %, the content of S of 0.005 to 0.040 wt %, and 0.25≤C/S≤4.00 exhibited particularly favorable saturation magnetic flux density, and coercivity.

On the contrary, the comparative examples of which the content of C and the content of S were out of the predetermined range had the coercivity which was too high. Furthermore, the magnetic permeability μ' was too low for some of the comparative examples.

Further, the coercivity was too high and the magnetic permeability μ' was too low for the comparative examples having the content of C and the content of S within the predetermine range but having C/S out of the predetermined range.

Table 7 shows the examples and the comparative examples of which the amount of Ti was varied.

The examples of Table 7 having the amount of Ti within 0.001 to 0.080 wt % exhibited favorable saturation magnetic flux density, coercivity, and magnetic permeability μ'. Particularly, the examples having the amount of Ti within 0.005 to 0.040 wt % exhibited particularly favorable saturation magnetic flux density and coercivity. On the contrary to this, the comparative example having the amount of Ti out of the predetermined range exhibited increased coercivity and decreased magnetic permeability μ'.

Table 8 shows the examples and the comparative examples of which the content (c) of P was varied.

The examples satisfying $0 \le c \le 0.040$ exhibited favorable saturation magnetic flux density, coercivity, and magnetic permeability μ'. Particularly, the example satisfying $0.001 \le c \le 0.040$ exhibited particularly favorable coercivity, and magnetic permeability μ'. Further, the examples satisfying $0.001 \le c \le 0.020$ exhibited particularly favorable saturation magnetic flux density. On the contrary to this, the example having c=0.045 had a ribbon before the heat treatment composed of the crystal phase, and the coercivity after the heat treatment significantly increased and the magnetic permeability μ' significantly decreased.

Table 9 shows the examples of which the composition of the main component was varied within the range of the present invention. All of the examples exhibited favorable saturation magnetic flux density, coercivity, and magnetic permeability μ'.

Table 10 shows the examples of which the type of M of the example 19 was changed.

According to Table 10, favorable properties were exhibited even when the type of M was changed.

Table 11 shows the examples of which a part of Fe of the example 16 was substituted with X1 and/or X2.

According to Table 11, favorable properties were exhibited even when a part of Fe was substituted with X1 and/or X2.

Table 12 shows the examples of which the average grain size of the initial fine crystals and the average grain size of the Fe-based nanocrystal alloy of the example 16 were varied by changing the rotating speed and/or the heat treatment temperature of the roll.

When the average grain size of the initial fine crystal was 0.3 to 10 nm, and the average grain size of the Fe-based nanocrystal alloy was 5 to 30 nm, the saturation magnetic flux density and the coercivity were both favorable compared to the case of which the average grain size of the initial fine crystal and the average grain size of the Fe-based nanocrystal alloy were out of the above mentioned range.

The invention claimed is:

1. A soft magnetic alloy comprising a main component having a compositional formula of $(Fe_{(1-(\alpha+\beta))}X1_{\alpha}X2_{\beta})_{(1-(a+b+c))}M_aB_bP_c$, and a sub component including at least C, S and Ti, wherein X1 is one or more selected from the group consisting of Co and Ni, X2 is one or more selected from the group consisting of Al, Mn, Ag, Zn, Sn, As, Sb, Bi, and rare earth elements, "M" is one or more selected from the group consisting of Nb, Hf, Zr, Ta, Mo, W, and V, $0.020 \le a \le 0.14$, $0.020 \le b \le 0.20$, $0 \le c \le 0.040$, $\alpha \ge 0$, $\beta \ge 0$, and $0 \le \alpha+\beta \le 0.50$ are satisfied, when entire said soft magnetic alloy is 100 wt %, a content of said C is 0.001 to 0.050 wt %, a content of said S is 0.001 to 0.050 wt %, and a content of said Ti is 0.001 to 0.080 wt %, and when a value obtained by dividing the content of said C by the content of said S is C/S, then C/S satisfies $0.10 \le C/S \le 10$.

2. The soft magnetic alloy as set forth in claim 1, wherein $0.73 \le 1-(a+b+c) \le 0.93$ is satisfied.

3. The soft magnetic alloy as set forth in claim 1, wherein $0 \le \alpha\{1-(a+b+c)\} \le 0.40$ is satisfied.

4. The soft magnetic alloy as set forth in claim 1, wherein $\alpha=0$ is satisfied.

5. The soft magnetic alloy as set forth in claim 1, wherein $0 \le \beta\{1-(a+b+c)\} \le 0.030$ is satisfied.

6. The soft magnetic alloy as set forth in claim 1, wherein $\beta=0$ is satisfied.

7. The soft magnetic alloy as set forth in claim 1, wherein $\alpha=\beta=0$ is satisfied.

8. The soft magnetic alloy as set forth in claim 1 comprising a nanohetero structure composed of an amorphous phase and initial fine crystals, and said initial fine crystals exist in said amorphous phase.

9. The soft magnetic alloy as set forth in claim 8, wherein the initial fine crystals have an average grain size of 0.3 to 10 nm.

10. The soft magnetic alloy as set forth in claim 1 comprising a structure composed of Fe-based nanocrystals.

11. The soft magnetic alloy as set forth in claim 10, wherein the Fe-based nanocrystals have an average grain size of 5 to 30 nm.

12. The soft magnetic alloy as set forth in claim 1, wherein said soft magnetic alloy is formed in a ribbon form.

13. The soft magnetic alloy as set forth in claim 1, wherein said soft magnetic alloy is formed in a powder form.

14. A magnetic device comprising the soft magnetic alloy as set forth in claim 1.

* * * * *